United States Patent [19]

Fies et al.

[11] 4,214,160

[45] Jul. 22, 1980

[54] MASS SPECTROMETER SYSTEM AND METHOD FOR CONTROL OF ION ENERGY FOR DIFFERENT MASSES

[75] Inventors: William J. Fies, Portola Valley, Calif.; Ronald D. Smith, Bovingdon, Fed. Rep. of Germany; John R. Reeher; Michael S. Story, both of Los Gatos, Calif.

[73] Assignee: Finnigan Corporation, Sunnyvale, Calif.

[21] Appl. No.: 664,046

[22] Filed: Mar. 4, 1976 (Under 37 CFR 1.47)

[51] Int. Cl.[2] ..... H01J 39/34

[52] U.S. Cl. ..... 250/292; 250/290

[58] Field of Search ..... 250/292, 290

[56] References Cited

U.S. PATENT DOCUMENTS

| | | | |
|---|---|---|---|
| 3,235,724 | 2/1966 | Brubaker | 250/292 |
| 3,284,628 | 11/1966 | Gunther | 250/292 |
| 3,284,629 | 11/1966 | Von Zahn | 250/292 |
| 3,321,623 | 5/1967 | Brubaker | 250/292 |
| 3,784,814 | 1/1974 | Sakai | 250/292 |

FOREIGN PATENT DOCUMENTS

| | | | |
|---|---|---|---|
| 2352047 | 4/1975 | Fed. Rep. of Germany | 250/292 |

*Primary Examiner*—Craig E. Church

*Attorney, Agent, or Firm*—Flehr, Hohbach, Test, Albritton & Herbert

[57] ABSTRACT

Apparatus and method for programming the ion energy of ions being analyzed by a quadruple mass spectrometer where the axis potential applied to the quadruple rods is caused to vary in synchronism with a mass scan in order that the ions of each mass being analyzed may transit the quadruple with the most advantageous energy for proper analysis (that is, with substantially equal velocities) and the application of the ion scan voltage will not distort the fringing field at the entrance to the quadrupole.

3 Claims, 4 Drawing Figures

$a = \frac{V_{DC}\, e}{r_o^2\, \omega^2}$ $q = \frac{V_{RF}}{M r_o^2 \omega^2}$

MASS SPECTROMETER SYSTEM AND METHOD FOR CONTROL OF ION ENERGY FOR DIFFERENT MASSES

BACKGROUND OF THE INVENTION

The present invention is directed to a mass spectrometer system and method for control of ion energy for different masses.

In a quadrupole mass spectrometer, ions are accelerated through an electrically programmable mass filter. Only those ions having a mass to charge ratio, m/e, corresponding to the voltages impressed on, and the electrostatic field produced by, the quadrupole filter rods are collected at a detector. The output from the detector is an electric charge that is proportional to the time rate of arrival of ions and thus is a measure of the amount of the sample having a particular m/e ratio.

In actuality, a single mass is not selected but rather a mass scan is conducted where the applied radio frequency and dc voltages are increased in amplitude with a constant ratio. However, since these voltages are applied to a quadrupole system with a 180° phase shift the quadrupole axis potential remains constant and is normally near ground potential.

Moreover, the theoretical equations which are well-known for describing the action of a multi-pole mass spectrometer theoretically show that the potential difference between the ionizing volume from which the ions are injected into the mass filter and the axis of the quadrupole system should remain constant. However, in practice experience has shown this is not true. Specifically, at low masses the potential difference must be smaller than at high masses. In previous systems the potential applied to the ionizing volume has been made to scan in such a manner that the energy in the axial direction of the quadrupole was lower for low masses than for high masses. Specifically, this was accomplished by causing the ion energy to vary by applying a sweeping voltage to the ionizing volume. A disadvantage of this is its distorting effect on the extraction field produced by the focusing system between the ionizing volume and the mass filter. To maintain good sensitivity it is desirable to maintain good focusing; in other words, the ion optics should remain fixed. The foregoing distortion effect on the focusing by varying the potential of the ionizing volume has not heretofore been recognized.

In an alternate prior art method an additional dc potential was inserted between ground and the quadrupole itself. This, however, was merely a rough compromise which over a wide mass scan range would be ineffective.

OBJECT AND SUMMARY OF THE INVENTION

It is, therefore, a general object of the invention to provide an improved mass spectrometer system and method for control of ion energy for different masses.

In accordance with the above object there is provided a mass spectrometer system having a gas inlet means and an ionizing volume. A multi-pole mass filter has a plurality of electrodes. Focusing means couple the ionizing volume to the mass filter. Means are provided for applying to the electrodes a mass setting voltage consisting of a combination of a radio frequency voltage, $V_{RF}$, and a dc voltage, $V_{DC}$, of increasing amplitude to select an ion of a predetermined mass. This means also includes means connected to the electrodes and responsive to the mass setting voltage for adjusting the ion energy of the selected ion in accordance with the mass of the ion by changing the potential difference between the ionizing volume and the mean potential of the electrodes.

From a method standpoint there is provided in connection with the mass spectrometer of the above type the method including the step of varying in synchronism with the mass setting voltage the axis potential of the electrodes without distorting the fringing field produced by the focusing means in the initial ion injection portion of the mass filter and to maintain equal velocities.

DETAILED DESCRIPTION OF PREFERRED EMBODIMENT

Figure 1:
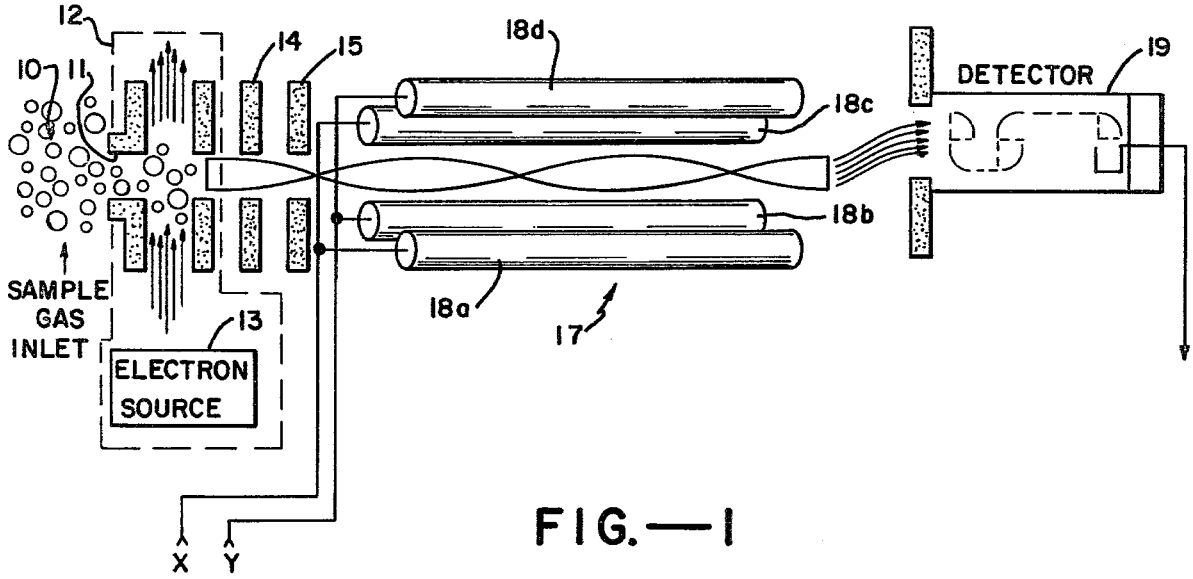
FIG. 1 is a symbolic block diagram of a typical mass spectrometer system.

Referring now to FIG. 1, illustrating the mass spectrometer system of the present invention, sample gas 10 from, for example, a gas chromatograph is admitted at a gas inlet 11 to an ionizing volume 12 as indicated in dashed outline. The ionizing volume includes as electron source 13 which is aligned to direct electrons through the ionizing volume to bombard the sample gas with electrons to create positive ions. Such ions are extracted by the electron optics which include focusing plates 14 and 15 and injected into the mass filter 17. The mass filter is a conventional quadrupole having cylindrical rods 18*a–d*. The rods are diagonally paired to a X voltage input and a Y voltage input in a manner well-known in the art. The mass setting voltage is applied as will be described in detail to the X and Y inputs. At the output of the mass filter a detector 19, conventionally an electron multiplier, collects ions which are passed along the Z axis of the mass filter and has an output proportional to the number of ions of the particular mass which has been collected.

In operation the voltages applied on the X and Y inputs give rise to an electrostatic field that gives bounded oscillation to an ion fragment of the selected mass to charge, m/e, ratio and unbounded oscillations to all other ions of a different m/e. Thus the unbounded oscillations result in the collection of such ions on the rods. Only selected ions are outputed to detector 19.

Figure 2:
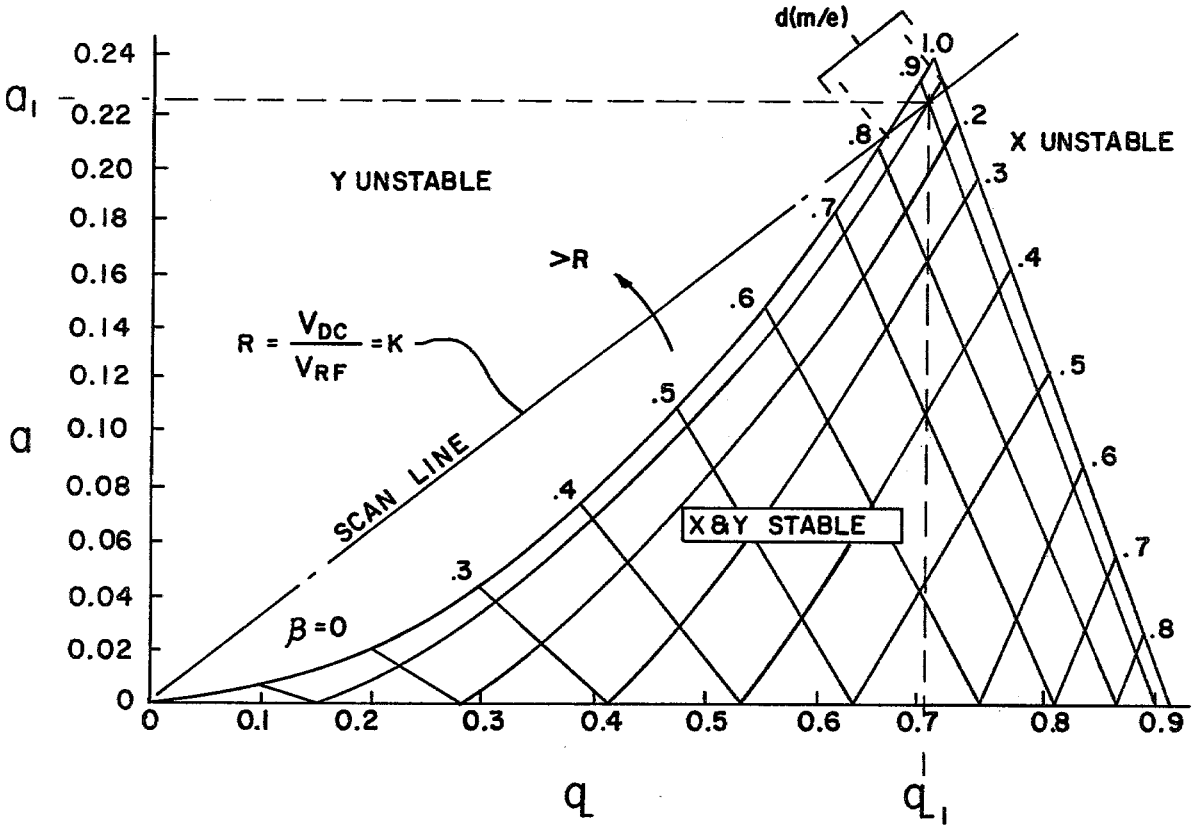
FIG. 2 is a stability diagram which is useful in understanding FIG. 1.

The mass setting voltage consists of a combination of a radio frequency voltage, $V_{RF}$, and dc voltage, $V_{DC}$, of increasing amplitude which selects an ion fragment of a predetermined mass. FIG. 2 illustrates the two pertinent values of "a" and "q" for stability. Specifically, the "a" value includes as parameters, $V_{DC}$, the mass/charge of the ion fragments, frequency, $\omega$, of the applied ac voltage and $r_0$ which is the effective radius of the quadrupole filter. The "q" factor varies as the ac voltage, $V_{RF}$. The solutions to these two transformations produce a region where XY are stable (that is, the orthogonal directions to the movement of ions through the quadrupole from the ionizing volume to the detector), and Y unstable and X unstable regions (where the nonselected ions are deposited on the collector rods).

For a given ratio of $V_{DC}$ to $V_{RF}$ all values of "a" and "q" lie on the scan line which passes through the origin and through two portions of the stability diagram. A point on the scan line corresponds to a value of mass charge ratio m/e of the ion. The small interval designated d(m/e) which lies within the stability diagram corresponds to the range of masses whose trajectories are stable and thus will be detected by the detector in the mass scan. It is apparent that if the ratio of the dc to ac voltage is increased the slope of the scan line is increased to thus provide for greater resolution. A mass scan is accomplished by increasing both the dc and ac voltages while maintaining, however, the ratio constant. However, theoretically the frequency can also be varied to produce a mass scan.

In general in quadrupole or multi-pole mass filter systems the ion energy is taken as the difference between the potential at which the ion is formed and the axis potential of the quadrupole system or in other words, its mean potential. Fringing field effects at the entry of the quadrupole are ignored. It is this potential that establishes the velocity of the ions in the Z direction and therefore the number of cycles the ion will remain in the quadrupole field. As discussed above, the classical equations show that this potential difference should remain constant. However, prior apparatus have varied this potential in order to compensate for the difference between low and high masses. In the present invention this is accomplished without distorting the fringing field so that the ions will transit the quadrupole with the most advantageous energy for their proper analysis. In other words, the sensitivity was effected and the amount and efficiency of collection of ion fragments with mass was decreased.

Figure 3:
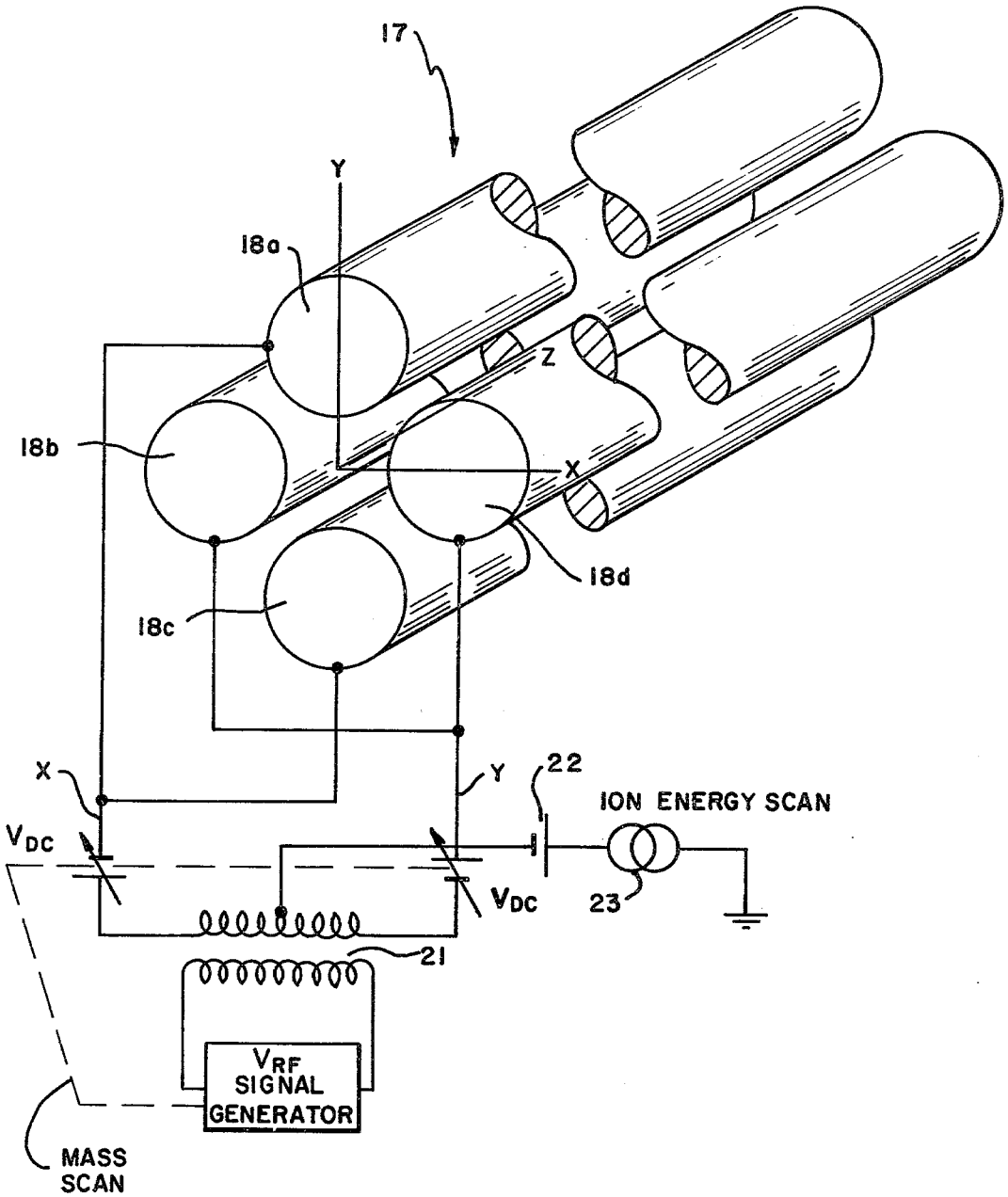
FIG. 3 is a simplified diagram of a portion of FIG. 1 with added scanning circuitry showing the theoretical concept of the present invention.

FIG. 3 illustrates in conceptual format the present invention and shows a standard mass filter 17 having X and Y inputs to the electrodes or rods 18*a–d*. The inputs are supplied by a $V_{RF}$ signal generator coupled by transformer 21 along with schematically illustrated dc sources $V_{DC}$. The dashed line shows the scanning of both the voltages so as to provide a mass scan, the scan line of FIG. 2, where $V_{RF}$ and $V_{DC}$ are both of increasing amplitude. This is well-known in the art. However, in accordance with the invention the mass filter 17 has applied to it an ion energy scan voltage which has a dc component 22 and a scanning component 23. This voltage varies the axis potential of the quadrupole according to a linear or nonlinear function of mass as will be described below.

Figure 4:
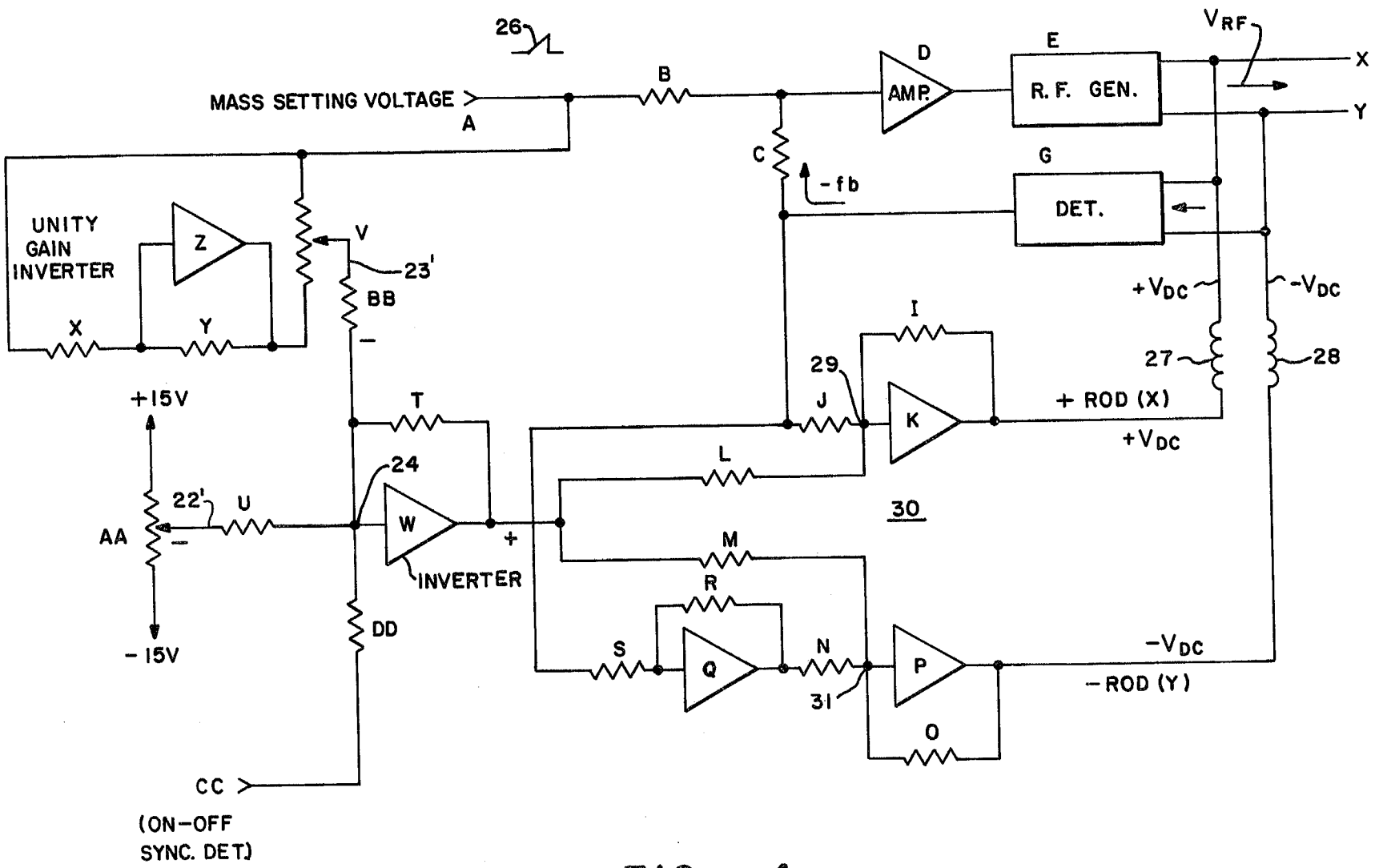
FIG. 4 is a schematic circuit diagram of the system for generating voltages in accordance with the present invention which are applied to the mass filter of FIG. 1.

The specific implementation of the ion scan system is shown in FIG. 4. In a conventional manner, the mass setting voltage which has ramp configuration as illustrated at 26 provides an increasing amplitude for both $V_{RF}$ and $V_{DC}$ is applied to an amplifier D through a resistor B the amplifier D in turn driving a radio frequency generator E which has two outputs generating $V_{RF}$ tied to the X and Y inputs of the mass filter. Thus, this applies the $V_{RF}$ of increasing amplitude. A feedback loop is established which causes $V_{RF}$ to be a linear function of the mass setting voltage and includes a feedback detector G in series with the resistor C connected to the input of amplifier D. This is, of course, a negative feedback loop.

The output of detector G is also connected to the $V_{DC}$ generation system indicated generally at 30 which includes an operational amplifier K with associated resistors I and J to generate a $+V_{DC}$ which is applied to the X input of the rods of the quadrupole and the operational amplifier P along with resistors N and O which provide the $-V_{DC}$ applied to the Y input. These two voltages are both filtered through radio frequency filters 27 and 28. A phase inverter QRS connected between the inputs of amplifiers K and P provide for the 180° phase inversion. Resistor values are chosen in such a way that the positive and negative electrodes are always at equal and opposite potential.

All of the foregoing, however, assumes that the inverter W has a zero output. The input of this amplifier is the summing point 24 of the ion energy scan voltages 22 and 23. Inverter W includes its feedback resistor T, of course. The output of inverter W is coupled to high voltage dc amplifiers K and P through resistors L and M.

In accordance with the invention, the potentiometer AA which is tied between +15 and −15 volt supplies and the resistor U provides at 22' an offset voltage which establishes the dc source 22 of FIG. 3. A scan voltage which is responsive to the mass setting voltage at the input A is produced by a unity gain inverter formed by amplifier Z and resistors X and Y at potentiometer V to provide at 23 a scan voltage which establishes scan voltage 23' of FIG. 3. The output of the potentiometer V may be adjusted to be equal to the mass setting voltage at A or may be varied through zero to a potential equal to but of opposite sign to the mass setting voltage. The voltage at 23' is summed through resistor BB at junction 24 with 22'.

In operation, it shall be assumed that resistors U, T and BB are of equal value. If potentiometer AA is adjusted so that it has a small output voltage, a voltage of equal magnitude but of opposite sign will appear at the output of inverter W and this voltage will be applied to the summing points of amplifiers K and P. Specifically, these summing points are indicated at 29 and 31. Because of the phase inversion to amplifier P there will be a subtractive process and an additive process at summing point 29. If, for example, the output of potentiometer AA is negative, the output of W will be positive and this will cause the outputs of both P and K to be more negative. In order to implement the scanning of the rod inputs X and Y potentiometer V is adjusted so that it has a nonzero output; thus, when the mass setting voltage is at zero, the output of potentiometer V at 23' is zero; but when the mass setting voltage is any other value corresponding to some mass to be examined by the mass spectrometer, then the output of V is not zero. If as the mass setting voltage applied to A is scanned toward higher masses, V scans toward a more and more negative voltage, the output of W because of its inversion action will scan toward more and more positive voltage. This has the effect of increasing the ion energy as the mass range is scanned toward higher masses. It is clear that the adjustment of potentiometers V and AA allow for adjusting rod offset for either positive or negative ions and for scanning the ion energy in either direction relative to the mass scan.

Finally, if it is desired to turn the ion beam on and off for purposes of synchronous detection then an on/off sync signal can be applied at input CC through resistor DD to summing point 24 the input of amplifier W.

With the technique of the present invention, the provision of the ion energy scan connected directly to the X and Y inputs of the mass filter offer compensation for low and high masses without affecting the fringing field which occurs in the initial ion injection portion of the mass filter. The ion scan voltage is optimally set by potentiometers V and AA to substantially maintain equal velocities of all ions. Moreover in general, the ion energy scan voltage is adjusted for efficiency. Although the present invention is described with reference to a quadrupole structure it applies equally to other multi-pole mass filters such as dodecapoles and even mono-pole filters which are classically analyzed as a multi-pole filter. Also, the invention is applicable to multi-pole filters with more than one ion beam.

What is claimed is:

1. In a mass spectrometer system having a gas inlet means and an ionizing volume, a multi-pole mass filter having a plurality of electrodes, focusing means for coupling said ionizing volume to said mass filter, and means for applying to said electrodes a mass setting voltage consisting of a combination of a radio frequency voltage, $V_{RF}$, and a dc voltage, $V_{DC}$, of increasing amplitude to select an ion fragment of a predetermined mass, such applying means also including means connected to said electrodes and responsive to said mass setting voltage for adjusting the ion energy of said selected ion in accordance with the mass of said ion by changing the potential differences between said ionizing volume and the axis potential of said electrodes.

2. A system as in claim 1 where said ion energy adjustment causes ions of different masses to travel with equal velocities through said mass filter.

3. A method of causing ions of different masses to travel with equal velocities through the mass filter of a mass spectrometer system having a gas inlet means which includes an ionizing volume, a multi-pole mass filter having a plurality of electrodes, focusing means for coupling said ionizing volume to said mass filter, and means for applying to said electrodes a mass setting voltage consisting of a combination of a radio frequency voltage, $V_{RF}$, and a dc voltage, $V_{DC}$, of increasing amplitude to select an ion fragment of a predetermined mass, said method comprising the step of varying in synchronism with said mass setting voltage the mean potential of said electrodes without distorting the fringing field produced by said focusing means in the initial ion injection portion of said mass filter and to maintain said equal velocities.

* * * * *